US006581760B1

(12) United States Patent
Robertson

(10) Patent No.: US 6,581,760 B1
(45) Date of Patent: Jun. 24, 2003

(54) FLEXIBLE LIGHTWEIGHT PROTECTIVE CONTAINER

(76) Inventor: William Gary Robertson, 3725 Litchfield La., Tarzana, CA (US) 91356

( * ) Notice: Subject to any disclaimer, the term of this patent is extended or adjusted under 35 U.S.C. 154(b) by 164 days.

(21) Appl. No.: 09/863,862

(22) Filed: May 22, 2001

(51) Int. Cl.[7] ..... A45C 11/04
(52) U.S. Cl. ..... 206/5; 206/320
(58) Field of Search ..... 206/5, 305, 320, 206/37, 38; 150/154–156, 160; 224/914, 933

(56) References Cited

U.S. PATENT DOCUMENTS 1,633,988 A * 6/1927 Jones ..... 150/155
3,266,491 A * 8/1966 Koslow ..... 150/154
3,766,954 A * 10/1973 Gentellalli ..... 150/154
4,856,140 A * 8/1989 Visco et al. ..... 150/155
4,863,013 A 9/1989 Eastman et al.
5,207,323 A * 5/1993 McConnell ..... 206/315.1
5,676,242 A * 10/1997 Scott ..... 206/5
6,212,688 B1 * 4/2001 Leslie ..... 2/161.6

* cited by examiner

*Primary Examiner*—Luan K. Bui
(74) *Attorney, Agent, or Firm*—Lyon & Harr; Mark A. Watson

(57) ABSTRACT

A container according to the present invention involves a thin lightweight case, or receptacle of any desired size or shape for holding or storing objects such as, eyeglasses, handheld electronic devices, pagers, cell phones, etc. The container is manufactured from any conventional material such as, a cloth, fabric, soft leather, rubber, plastic, or polymer material, or some combination thereof, and is preferably thin enough to be easily inserted into a user's pocket. The outer surface of the container is designed to provide a friction force when in a user's pocket, or in contact with a surface such as a car dash or a boat deck, for preventing the container from slipping out of the user's pocket, or from sliding along or falling off of the surface. Additionally, in one embodiment, the container is configured to prevent or reduce shock and vibration from being transmitted to objects within the container.

27 Claims, 4 Drawing Sheets

FLEXIBLE LIGHTWEIGHT PROTECTIVE CONTAINER

BACKGROUND

1. Technical Field

This invention relates to containers for holding objects or storing objects, and in particular, to a flexible lightweight reusable container, case, or receptacle for securely holding or storing objects such as eyewear, handheld electronic devices, pagers, cell phones, etc.

2. Related Art

Objects such as eyewear, handheld electronic devices, pagers, cell phones, etc., are often relatively fragile, and as such, are typically protected by providing a case or container for holding, carrying, and/or storing such objects. Over the years, various schemes have been suggested or adopted for ensuring that objects held or carried within the case or container are partially or completely protected. However, such schemes are subject to several important limitations.

For example, objects such as prescription or non-prescription eyeglasses are often provided to a user along with either a soft case, or a hard clamshell type case. Both types of cases have similar problems. For example, both soft cases and hard cases for eyewear are typically made from, or externally covered with, a smooth or semi-smooth material such as plastic or leather. Consequently, because such cases are relatively smooth, when one is placed in a loose pocket, such as a shirt or jacket pocket, the case tends to slip out of the pocket when a user bends over, runs, moves suddenly, or is otherwise active. As a result, damage to or loss of the object within the case is a frequent problem. Further, users often place such cases on a car dashboard while driving. Because such cases are relatively smooth, as described above, they tend to slide around and fall off of the dashboard as the car moves about. Clearly such problems apply to cases for many other types of objects, including, for example, handheld electronic devices, pagers, cell phones, etc.

An additional problem of conventional soft or hard cases is that they tend to be rather bulky. Consequently, while the object contained within such cases might readily fit within a pocket such as a shirt or pant pocket, the case itself is often either too large to fit within such pockets, or if it does fit, it can create an unsightly bulge within the pocket. Further, where objects are to be carried within purses or book bags, the conventional cases are also often considered to be too large or bulky to be used. Consequently, users often simply remove the object from the case and place the object itself directly within a pocket, purse, or book bag. Unfortunately, the object is then subject to being damaged or scratched either by the material of the pocket, purse or book bag, or by other items contained within the pocket, purse or book bag, such as, for example, zippers, buttons, keys, coins, etc.

Further, because conventional soft or hard cases tend to be bulky as described above, once a user removes an object from such cases, the user is then faced with the problem of what to do with the case. Thus, for example, in accordance with the reasons described above, the user is unlikely to place such a case in the user's pocket. Consequently, such cases are often misplaced or left behind after the user removes an object from the case.

In addition, both conventional soft and hard cases or containers for carrying small objects such as, for example, eyeglasses, handheld electronic devices, pagers, cell phones, etc., tend to be relatively rigid. Consequently, such cases or containers provide little if any protection against shock, such as when the case is dropped. In fact, with respect to hard cases, objects carried within such cases tend to bounce around within the case as the case is subjected to shock or vibration experienced when a user that is carrying such a case runs, jumps, falls, or drops the case. Such bouncing around within the case or container can be damaging to eyeglasses or sensitive electrical devices.

Therefore, in order to overcome the limitations of current cases and containers, what is needed is a case or container that is fabricated so as to avoid the problem of smooth or semi-smooth material coverings so as to prevent the container from slipping or falling from the user's pocket, and to prevent the container from falling off or sliding along surfaces such as a car dashboard, as described above. Further, such a container should be thin enough or small enough to be placed within a user's pocket, purse, or book bag, whether or not an object is contained within the case. In addition, the material forming the interior of such a container should protect items contained within, such as glass or plastic lenses, eyeglasses, or display screens from being scratched or otherwise damaged either by the material of a pocket, purse, or book bag in which the container is placed, or by other items within the pocket, purse, or book bag. Finally, such a container should provide a level of protection against shock and vibration for objects held within the container.

SUMMARY

The present invention involves a thin lightweight container, such as a case or receptacle, for holding or storing objects such as, for example, eyeglasses, handheld electronic devices, pagers, cell phones, etc. This container satisfies all of the foregoing needs. Specifically, the container is preferably thin enough that it can be easily inserted into a user's pocket when it contains an object as described above. The container can be manufactured from any conventional material such as, for example, a cloth, fabric, leather, rubber, plastic, or polymer material, or some combination thereof. Further, the material comprising the outer surface of the container is designed to provide a sufficient friction force when in a user's pocket, or in contact with a surface such as a car dash or a boat deck, to prevent or reduce the likelihood of the container slipping out of the pocket or sliding along or falling off of the surface. In addition, the material comprising the interior of the container is soft and flexible in order to protect items contained within, such as glass or plastic lenses, eyeglasses, or display screens, from being scratched or otherwise damaged by the container itself, by the material of a pocket, purse, or book bag in which the container is placed, or by other items within the pocket, purse, or book bag. Also, in one embodiment, the container is soft and flexible in order to prevent or reduce shock and vibration from being transmitted to objects contained within. Such shock or vibration can occur when a user that is carrying the case runs, jumps, falls, or drops the container, or when the container is placed on the dash of a moving car, or on the surface of a moving boat or other vehicle. Finally, the container of the present invention can be manufactured in any desired size or shape to provide storage for any particular object of any particular size.

In general, a container according to present invention is embodied in a flexible container sized to snugly fit particular objects. The container is generally shaped as a flattened tube, closed at one end, with an elastically restricted opening extending from an opposite end. The elastic restriction of the open end serves to prevent objects from inadvertently falling out of the container, regardless of the position or orientation of the container. Further, in one embodiment, the container includes a stiffener member along at least one longitudinal edge of the flattened tube for maintaining the general shape of the flexible container and further serving to provide additional protection for any objects held within the container by reducing potential longitudinal deformation of the container.

Specifically, the container of the present invention, being generally shaped as a flattened tube, has a generally rectangular profile. The elastically restricted open end extends from the generally rectangular profile of the container, and has a generally trapezoidal shape of decreasing dimension as it extends from the container. Consequently, the edge of the open end of the container has a smaller cross section than the rectangular body of the container. In operation, the edge of the elastically restricted open end of the container is pulled open, then the object to be stored within the container is inserted into the open end, and thus into the rectangular body of the container. Once the object has been inserted into the body of the container, the edge of the open end of the container is released, and the elasticity of the open end of the container naturally restricts that open end to prevent the object contained within the container from inadvertently falling or sliding out of the container. Removal of the object from within the container is accomplished by simply reversing the aforementioned insertion process.

Additional embodiments of a container according to the present invention include use of a printable outer surface for printing, silk-screening, or otherwise placing logos, advertising, or other text or images on the container. In addition, in another embodiment of a container according to the present invention, the container is fabricated from a material suitable for cleaning glass or plastic lenses, eyeglasses, or display screens of electronic devices without scratching or otherwise damaging such lenses, eyeglasses or display screens. Consequently, such a container is useful for both storing and cleaning lenses, eyeglasses and electronic devices with display screens. Further, in a related embodiment, the container is fabricated from a washable material, such as for example, a natural or synthetic fabric or material, or some combination thereof. As a result, the container can be easily cleaned after being used itself to clean lenses, eyeglasses, or the display screens of electronic devices.

In another embodiment, the container is fabricated, at least in part, from a buoyant material, such as, for example, a flexible foam, or neoprene material, so as to provide floatation for the container and any objects contained therein in the event that the container is placed or dropped into water or other liquid. Such an embodiment is particularly useful where the container is to be used in an environment such as near a swimming pool, lake or ocean, where there is a possibility that a user might drop the container into the swimming pool, lake or ocean, or over the side of a boat or other watercraft. In a related embodiment, the container is either coated with, or fabricated from material that is partially or fully waterproof in order to limit or prevent water or other liquids from entering the container. Such an embodiment is particularly useful for protecting objects within the container from spills of various liquids, such as, for example, water, soda, cleaning fluids, ink, etc.

In still another embodiment, the material used to fabricate the container is itself elastic, such that it expands to conform to the shape of any object placed therein. Consequently, the object is held securely, while being cushioned from shock and vibration, and fully or partially protected from damage caused by either dropping the container, or by dropping other objects onto the container. Finally, it should be appreciated that any or all of the alternate embodiments, as described throughout this document, may be used in any desired combination.

The foregoing and still further features and advantages of the present invention as well as a more complete understanding thereof will be made apparent from a study of the following detailed description of the invention in connection with the accompanying drawings and appended claims.

DESCRIPTION OF THE DRAWINGS

The specific features, aspects, and advantages of the present invention will become better understood with regard to the following description, appended claims, and accompanying drawings in which like reference numbers represent corresponding parts throughout.

DESCRIPTION OF THE PREFERRED EMBODIMENTS

In the following description of the preferred embodiments of the present invention, reference is made to the accompanying drawings, which form a part hereof, and in which is shown by way of illustration specific embodiments in which the invention may be practiced. It is understood that other embodiments may be utilized and structural changes may be made without departing from the scope of the present invention.

Introduction

The present invention involves a thin lightweight container, such as a case or receptacle, for holding or storing objects such as, for example, eyeglasses, handheld electronic devices, pagers, cell phones, etc. This container is preferably thin enough that it can be easily inserted into a user's pocket when it holds or contains an object as described above. The container can be manufactured from any conventional material such as, for example, a cloth, fabric, soft leather, rubber, plastic, or polymer material, or some combination thereof.

Components

Figure 1:
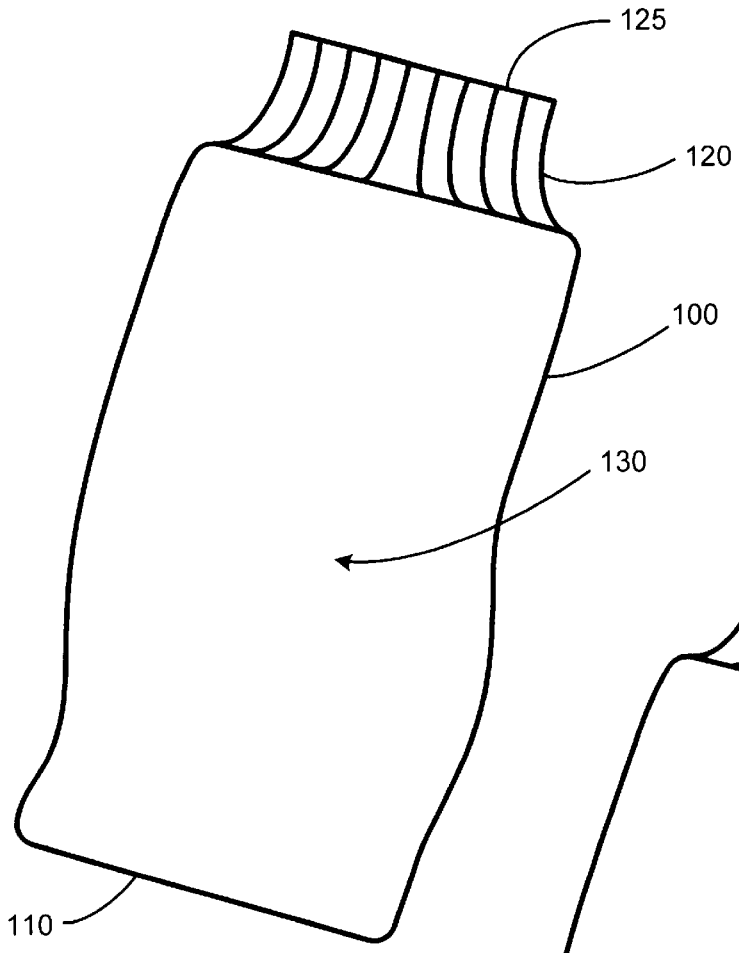
FIG. 1 is an exemplary perspective view of a container according to the present invention.

In general, a container according to present invention is embodied in a flexible container sized to snugly fit particular objects. In fact, the container of the present invention can be manufactured in any desired size or shape to provide storage and protection for any particular object of any particular size. As illustrated in FIG. 1, the container 100 is generally shaped as a flattened tube, closed at one end 110, with an elastically restricted opening 120 extending from an opposite end. The elastic restriction of the open end 120 serves to prevent objects from inadvertently falling out of the container 100, regardless of the position or orientation of the container.

The container 100, being generally shaped as a flattened tube, has a generally rectangular profile as illustrated in FIG. 1. The elastically restricted open end 120 that extends from the generally rectangular profile of the container 100 has a generally trapezoidal shape of decreasing dimension as it extends from the container. Consequently, as illustrated by FIG. 1, the edge 125 of the open end of the container 100 has a smaller cross section than the rectangular body of the container.

The material comprising the outer surface 130 of the container 100 is designed to provide a sufficient friction force to either prevent or reduce the likelihood of the container from sliding along or falling off of surfaces such as a car dash or a boat deck, as well as to prevent or reduce the likelihood of the container slipping out of a user's pocket. Additionally, in one embodiment, the material comprising the outer surface 130 of the container 100 is designed to be soft and flexible in order to prevent or reduce shock and vibration from being transmitted to objects contained within. Such shock or vibration can occur when a user that is carrying the container runs, jumps, falls, or drops the container, or when the container is placed on the dash of a moving car, or on the surface of a moving boat or other vehicle.

Additionally, the material comprising the interior of the container 100 is designed to be soft and flexible so as to protect items contained within, such as glass or plastic lenses, eyeglasses, or display screens from being scratched or otherwise damaged by that material. Further, when items such as glass or plastic lenses, eyeglasses, or electronic devices having display screens are held within the container 100, the material forming the container further serves to cushion and protect those items from being scratched or otherwise damaged either by the material of a pocket, purse, or book bag in which the container is placed, or by other items within the pocket, purse, or book bag such as, for example, zippers, buttons, keys, coins, etc.

In still another embodiment, the material used to fabricate the container 100, or portions thereof, is itself elastic, such that the container expands to conform to the shape of any object placed therein. Consequently, the object is held securely, while being cushioned from shock and vibration, and fully or partially protected from damage caused by either dropping the container, or by dropping other objects onto the container.

In a further embodiment, the material comprising the outer surface 130 of the container 100 is printable to allow for printing, silk-screening, or otherwise placing logos, text or images on the container. As the container 100 is preferably relatively inexpensive to manufacture, this printable embodiment is particularly useful for advertising purposes. For example, the container can be printed with any desired logo or advertisement then distributed with objects such as eyeglasses or handheld electronic devices.

Further, in another embodiment, conventional "glow-in-the-dark" type ink or coloring is used for placing logos, text or images on the container. Similarly, in another embodiment, the entire surface of the container 100 is coated with such ink or coloring. Such glow-in-the-dark ink or coloring typically operates by emitting light for a period of time after it is exposed to a sufficiently strong light source. This embodiment is useful for providing uniquely customized logos, images, or icons on the outer surface of the container 100. Further, this embodiment is also useful for assisting a user in locating the container 100 in a dark area. In a related embodiment, the container 100 may be manufactured, at least in part, from conventional plastic or other synthetic materials that glow or emit light in the manner described above.

In still another embodiment, the container 100 is fabricated from a conventional flexible material suitable for cleaning glass or plastic lenses, eyeglasses, or display screens of electronic devices without scratching or otherwise damaging such lenses, eyeglasses or display screens. Such conventional materials include any of a number of synthetic materials, natural materials, such as cotton, or any of a number blends of synthetic and natural materials. When manufactured from such materials, the container 100 is useful for both storing and cleaning lenses, eyeglasses and electronic devices with display screens. Further, in a related embodiment, the container 100 is fabricated from a washable material, such as for example, a natural or synthetic fabric or material, or some combination thereof. As a result, the container can be easily cleaned after being used itself to clean lenses, eyeglasses, or the display screens of electronic devices.

In another embodiment, the container 100 is fabricated, at least in part, from a buoyant material, such as, for example, a flexible foam, or neoprene material. This embodiment provides a floatation capability for the container 100 and any objects contained therein in the event that the container is placed or dropped into water or other liquid. Such an embodiment is particularly useful where the container 100 is to be used in an environment such as near a swimming pool, lake or ocean where there is a possibility that a user might drop the container into the swimming pool, lake or ocean, or over the side of a boat or other watercraft. In a related embodiment, the container 100 is either coated with, or fabricated from material that is partially or fully waterproof in order to limit or prevent water or other liquids from entering the container. Such an embodiment is particularly useful for protecting objects within the container 100 from spills of various liquids, such as, for example, water, soda, cleaning fluids, ink, etc. In still another related embodiment, the elastically restricted open end 120 of the container 100 forms a water resistant seal when closed to prevent or reduce the intrusion of water or other liquid into the container.

Additional Embodiments

Figure 2:
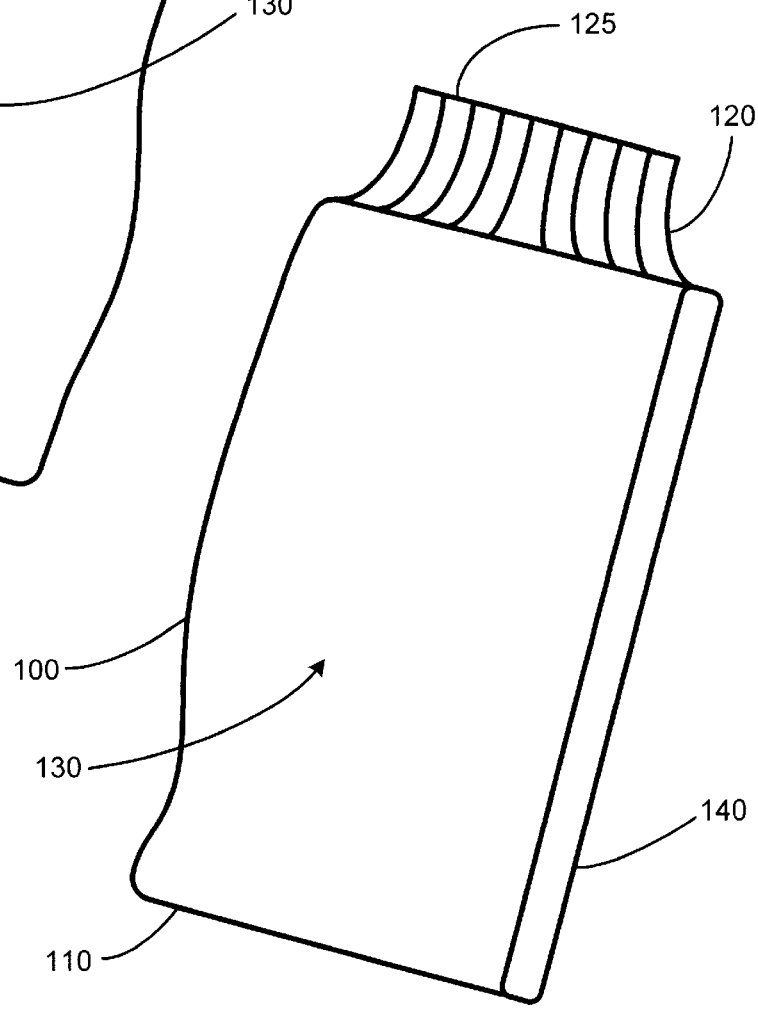
FIG. 2 is an exemplary perspective view of an alternate embodiment of a container according to the present invention shown with a stiffener member along a longitudinal edge of the container.

In another embodiment, as illustrated by FIG. 2, the container 100 includes a stiffener member 140 along at least one longitudinal edge of the flattened tube for maintaining the general shape of the flexible container and further serving to provide additional protection for any objects held within the container by reducing potential longitudinal deformation of the container. In addition, this stiffener member 140 also serves to facilitate the insertion of objects into the container 100 by generally maintaining the shape of the container while objects are being inserted into the container.

Figure 3:
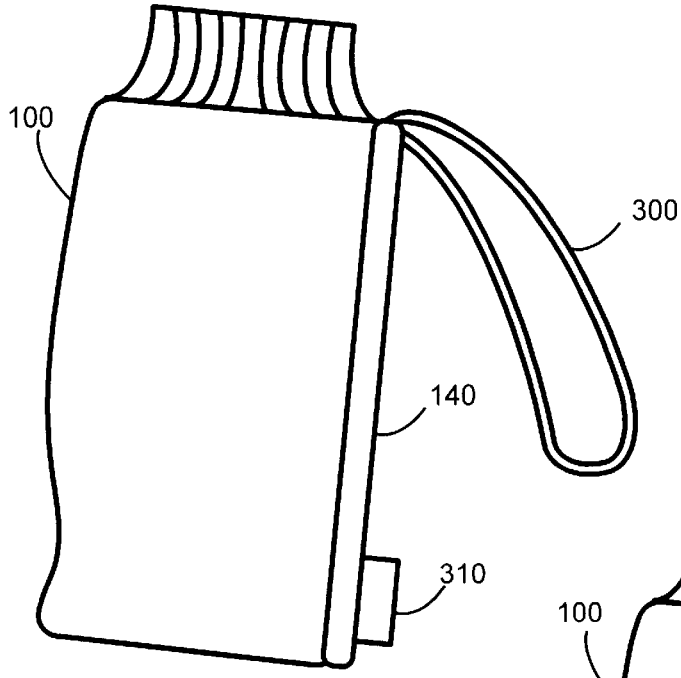
FIG. 3 is an exemplary perspective view of an alternate embodiment of the container of FIG. 2, shown with an attached carrying handle.

In a further embodiment, as illustrated by FIG. 3, the container 100 includes a carrying strap 300. This carrying strap is connected to the container 100 near the elastically restricted open end 120 of the container. The carrying strap 300 is useful for carrying or holding the container 100.

Further, a user may also use the carrying strap 300 by placing a hand through the strap such that it hangs off of the user's wrist. This embodiment is useful where a user desires to ensure that the container 100 is not misplaced or dropped, and where the user either does not want to place the container in a pocket, purse, book bag, or the like, or does not have a pocket, purse, book bag, or the like to place the container into. In a related embodiment, the carrying strap 300 is removably attached to the container 100 using any of a number of conventional methods, such as, for example, a button, a snap, or a hook and loop arrangement. A further advantage of the removable carrying strap 300 is that in one embodiment, the carrying strap can be connected to a belt, purse, or other garment for easy, convenient, and secure means for carrying the container 100.

Figure 4:
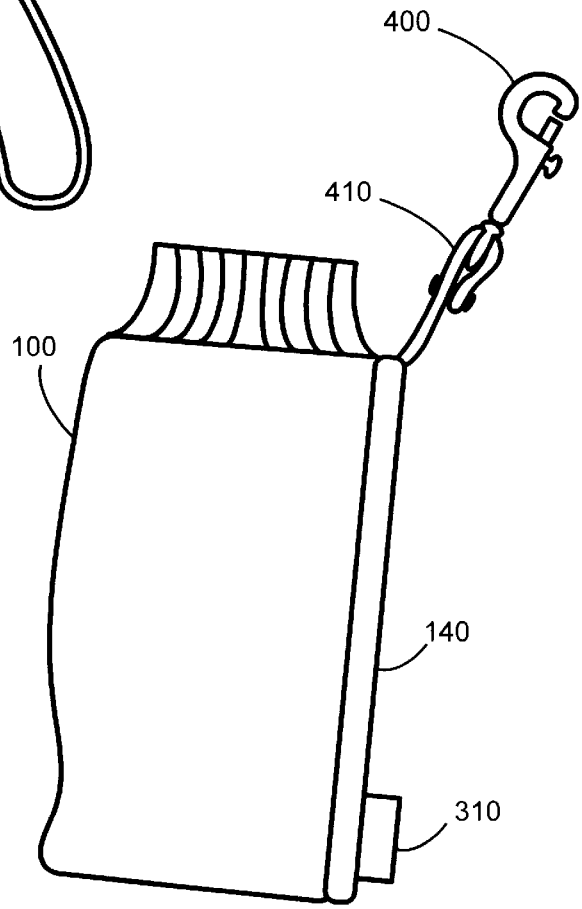
FIG. 4 is an exemplary perspective view of an alternate embodiment of the container of FIG. 2, shown with an attached carrying clip.

In a related embodiment, as illustrated by FIG. 4, the container 100 further includes a conventional carrying clip 400 coupled to the container via a strap 410. This carrying clip 400 allows the container to be hooked or connected to a belt, belt loop, purse, garment, luggage, or other items for easy, convenient, and secure means for carrying the container 100.

Figure 5:
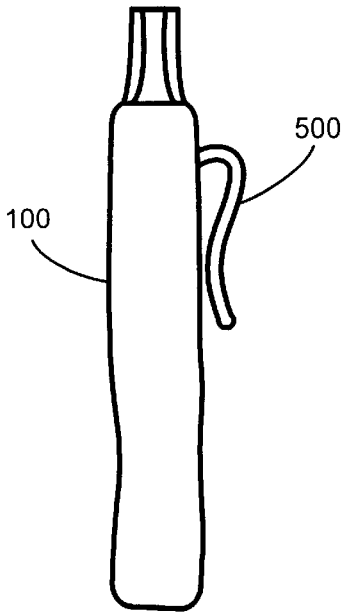
FIG. 5 is an exemplary side view of an alternate embodiment of the container of FIG. 1, shown with an attached garment clip.

In another related embodiment, as illustrated by FIG. 5, the container 100 further includes a conventional garment clip 500 or the like coupled to the container 100. This garment clip 500 allows the container to be hooked or connected to a belt, belt loop, purse, garment, luggage, or other items for easy, convenient, and secure means for carrying the container 100.

In still another embodiment, illustrated by FIG. 3 and FIG. 4, the container 100 includes a tab or label 310 extending from one edge of the container 100. This tab 310 is useful for providing a logo, manufacturer name, or other text or information such as a name or instructions for use or care.

Operation

Figure 7:
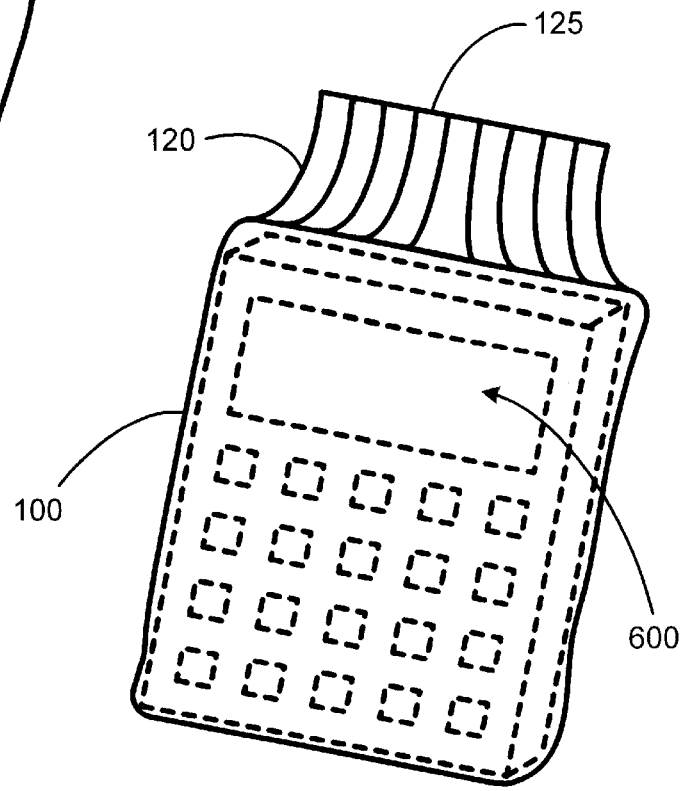
FIG. 7 is a partially transparent perspective view of the container of FIG. 6, shown with the object fully inserted into the container.
Figure 8:
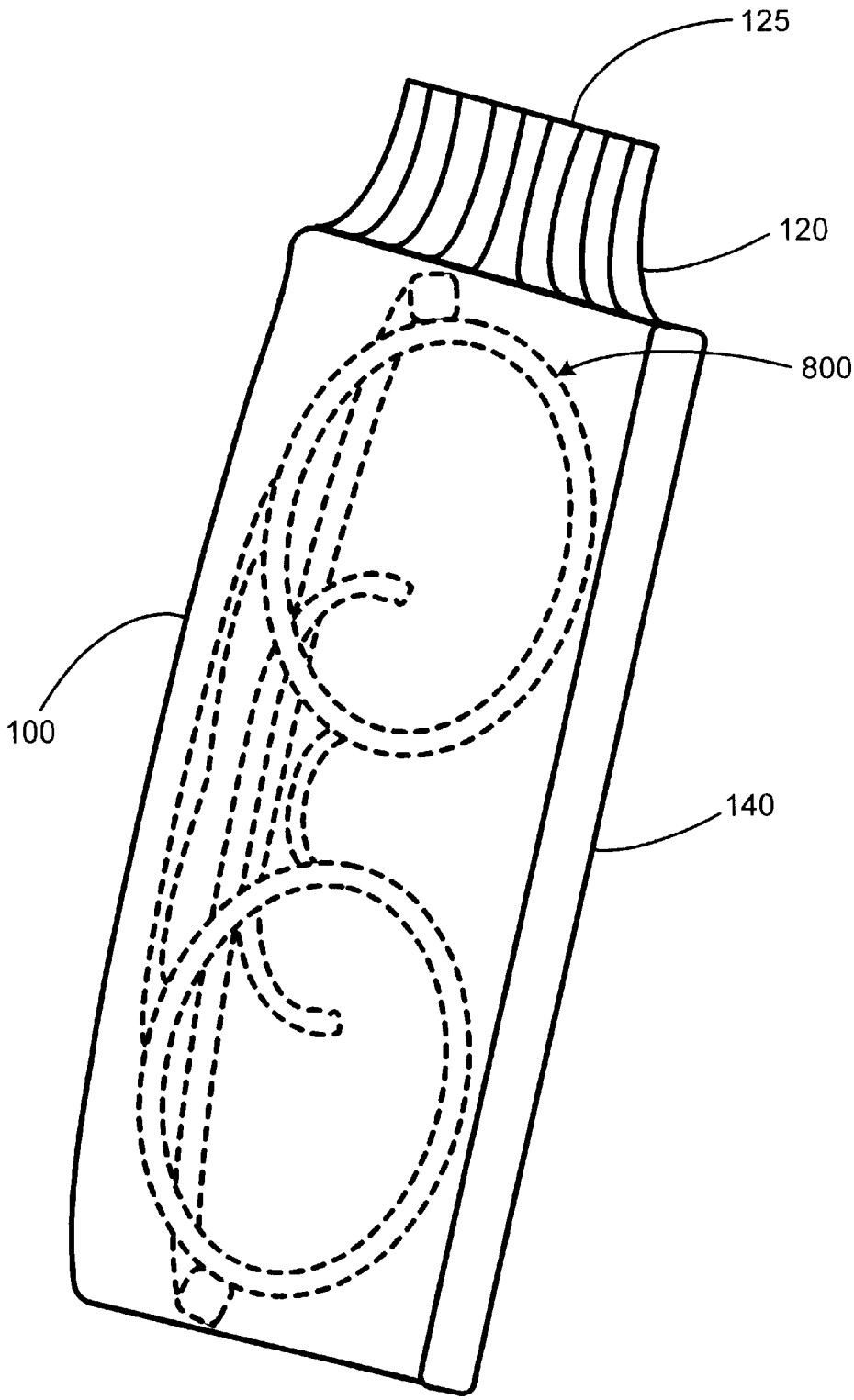
FIG. 8 is a partially transparent perspective view of the container of FIG. 2, shown with a pair of eyeglasses stored in the container.

The following discussion provides an exemplary description of a preferred mode of operation. This discussion is intended for illustrative purposes only, and is not intended to limit the scope of the invention. The following discussion describes methods for inserting and removing objects from the container in accordance with the present invention with reference to FIG. 6, FIG. 7, and FIG. 8. In general, FIG. 6 illustrates an object 600 being inserted into the container 100, FIG. 7 illustrates the object fully inserted into the container, and FIG. 8 illustrates a pair of eyeglasses 800 being stored in an alternate embodiment of the container 100.

Figure 6:
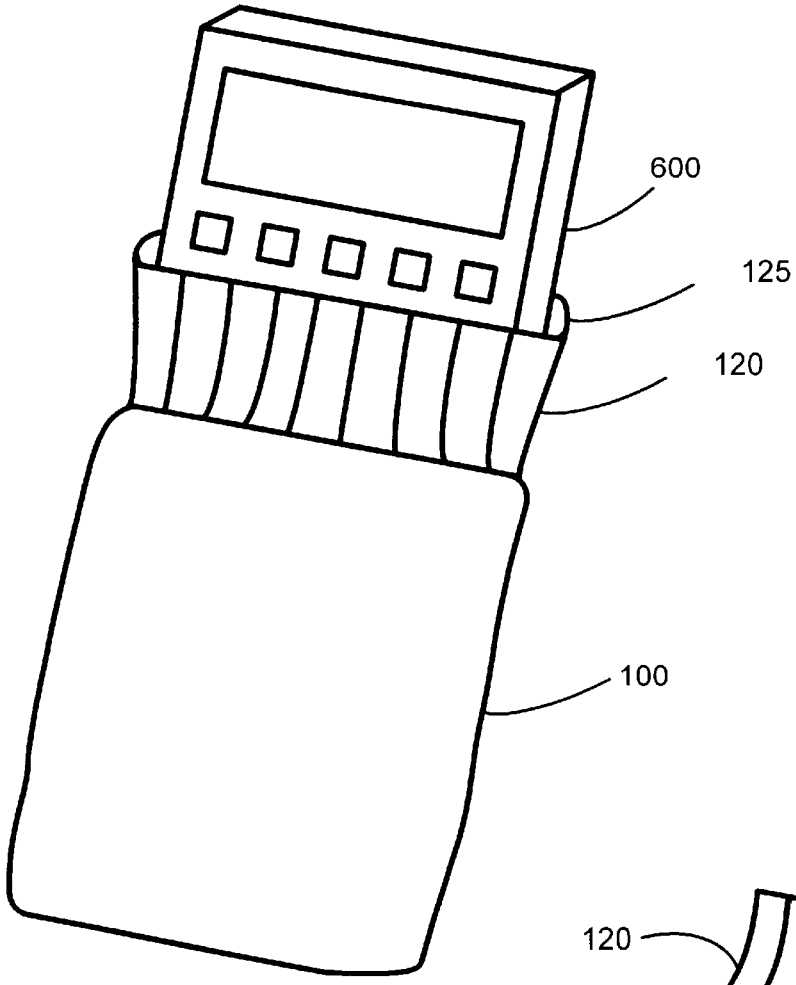
FIG. 6 is a perspective view of the container of FIG. 1, shown with an object being inserted into the container.

In particular as illustrated by FIG. 6, in operation, the edge 125 of the elastically restricted open end 120 of the container 100 is first pulled open from a closed position. An object 600 to be stored within the container is then inserted into the open end 120, and thus into the generally rectangular body of the container 100. Once the object 600 has been fully inserted into the body of the container 100, as illustrated by FIG. 7, the edge 125 of the open end 120 of the container 100 is released. Once the edge 125 has been released, the elasticity of the open end 120 of the container 100 naturally restricts and closes that open end to prevent the object 600 contained within the container from inadvertently falling or sliding out of the container. Removal of the object 600 from within the container is accomplished by simply reversing the aforementioned insertion process.

In addition, as discussed above, in one embodiment, the elastically restricted open end 120 of the container 100 forms a water resistant seal when closed to prevent or reduce the intrusion of water or other liquid into the container. In this embodiment, the elasticity of the open end of the container is sufficient to completely close the edge 125 of the open end 120 of the container 100 when the edge is released after inserting an object into the container as described above. Further, where the material forming the outer surface 130 of the container 100 is waterproof, as described above, the completely closed edge 125 of the open end 120 of the container 100 provides a barrier to water intrusion into the container.

The foregoing description of the invention has been presented for the purposes of illustration and description. It is not intended to be exhaustive or to limit the invention to the precise form disclosed. Many modifications and variations are possible in light of the above teaching. For example, it should be appreciated that any or all of the alternate embodiments, as described throughout this document, may be used in any desired combination to produce a plurality of hybrid embodiments of a container in accordance with the present invention. Thus, it is intended that the scope of the invention be limited not by this detailed description, but rather by the claims appended hereto.

What is claimed is:

1. A container for storing at least one object, comprising:

a body formed from a flexible flattened tube, the tube being closed on a first end;

an elastically restricted opening extending from a second end opposite the first end, the elastically restricted opening decreasing in diameter in a direction away from the second end;

wherein the elastically restricted opening is capable of expanding to allow for insertion of objects into the body of the container;

wherein an outer surface of the body of the container provides a friction force when in contact with a surface; and at least one stiffening member attached along at least one longitudinal edge of the body of the container, and wherein the stiffening member is capable of limiting potential longitudinal deformation of the body of the container.

2. The container of claim 1 further comprising a carrying handle coupled to the body of the container in proximity to the second end.

3. The container of claim 2 wherein the carrying handle is removably coupled to the body of the container.

4. The container of claim 1 wherein the elastically restricted opening is further capable of automatically closing after the object is inserted into the body of the container.

5. The container of claim 1 wherein the body of the container is fabricated from a soft, flexible material for conforming to the object after the object has been inserted into the body of the container, and wherein the body of the container is capable of providing protection to the object from shock and vibration.

6. The container of claim 1 wherein the material used to fabricate the body of the container is printable.

7. The container of claim 6 wherein glow-in-the-dark ink is used for printing on the surface of the body of the container.

8. The container of claim 1 wherein the body of the container is fabricated from glow-in-the-dark materials.

9. The container of claim 1 wherein the body of the container is fabricated from materials suitable for cleaning glass and plastic lenses and screens.

10. The container of claim 1 wherein the body of the container is fabricated from washable materials.

11. The container of claim 1 wherein the body of the container is fabricated from floatable materials.

12. The container of claim 11 wherein the body of the container and the elastically restricted opening are water resistant.

13. The container of claim 1 further comprising a carrying clip coupled to the body of the container in proximity to the second end.

14. The container of claim 1 further comprising a garment clip coupled to the body of the container in proximity to the second end.

15. A container assembly comprising:

a container body, the container body forming a generally rectangular, flattened, hollow body being closed on a first end;

an elastically restricted opening extending from a second end of the container body, the second end being opposite the first end of the container body;

at least one stiffening member attached along at least one longitudinal edge of the container body, and extending from the first end of the container body to the second end of the container body;

a carrying handle coupled to the container body in proximity to the second end; and wherein an outer surface of the container body provides a friction force when in contact with a surface.

16. The container assembly of claim 15 wherein the container body and the elastically restricted end are water resistant for protecting an object contained within the container body from liquid spills and immersion in liquid.

17. The container assembly of claim 15 wherein the container body is capable of floating when the container is in a liquid substance.

18. The container assembly of claim 15 wherein the container body elastically conforms to the surface of an object contained within the container, and wherein the container body protects the object from shock and vibration loads.

19. The container assembly of claim 15 further comprising a tab extending from one edge of the container body, and wherein the tab is used for providing any or all of a logo, text, and an image.

20. A water resistant flexible storage container for securely and safely storing objects of various shapes and sizes, comprising:

generally tubular container body having a first closed end opposite an opening;

the opening further comprising an elastically restricted second end of decreasing diameter as the second end extends outward from the container;

at least one stiffening member attached along at least one longitudinal edge of the container body for stiffening the container to limit potential longitudinal deformation of the container body;

wherein the container body elastically conforms to the surface of an object contained within the container for protecting the object from shock and vibration loads; and wherein the container body and the elastically restricted second end are water resistant for protecting the object contained within the container body from liquid spills and immersion in liquid.

21. The storage container claim 20 wherein the container body is capable of floating in a liquid.

22. The storage container of claim 20 wherein the container body is fabricated from materials suitable for cleaning glass and plastic lenses and screens without scratching or otherwise damaging the glass and plastic lenses and screens.

23. The storage container of claim 20 wherein the container body is fabricated from washable materials.

24. The storage container of claim 20 wherein the elastically restricted second end of the container body is capable of expanding to allow for insertion of the object into the container.

25. The storage container of claim 22 wherein the elastically restricted second end of the container body is further capable of automatically closing to provide a water resistant seal after the object is inserted into the container.

26. The storage container of claim 22 further comprising a carrying clip coupled to the container body.

27. The container of claim 22 further comprising a garment clip coupled to the container body.

* * * * *